United States Patent [19]

Gupta et al.

[11] Patent Number: 5,071,675

[45] Date of Patent: Dec. 10, 1991

[54] METHOD OF APPLYING LIQUID SIZING OF ALKYL KETENE DIMER IN ETHANOL TO CELLULOSE FIBERS ENTRAINED IN A GAS STREAM

[75] Inventors: Maharaj K. Gupta, Renton; Amar N. Neogi, Seattle; Richard H. Young, Sr., Puyallup, all of Wash.

[73] Assignee: Weyerhaeuser Company, Tacoma, Wash.

[21] Appl. No.: 326,187

[22] Filed: Mar. 20, 1989

[51] Int. Cl.[5] ..... B05D 7/00

[52] U.S. Cl. ..... 427/213; 162/169; 162/185

[58] Field of Search ..... 427/213; 162/158, 164.1, 162/169, 183, 185; 65/9; 264/136

[56] References Cited

U.S. PATENT DOCUMENTS

| | | | |
|---|---|---|---|
| 2,757,150 | 7/1956 | Heritage | 260/17.2 |
| 2,768,095 | 10/1956 | Tadema et al. | 427/213 |
| 2,950,752 | 8/1960 | Watson et al. | 154/1 |
| 3,010,161 | 11/1961 | Duvall | 19/156 |
| 3,081,207 | 3/1963 | Fox | 154/44 |
| 3,212,961 | 10/1965 | Weisgerber | 427/391 |
| 3,361,632 | 5/1970 | Gagliardi et al. | 117/143 A |
| 3,494,992 | 2/1970 | Wiegand | 264/121 |
| 3,577,312 | 5/1971 | Videen et al. | 162/148 |
| 3,616,002 | 11/1972 | Paquette et al. | 156/180 |
| 3,671,296 | 6/1972 | Funakoshi et al. | 117/100 B |
| 3,673,021 | 6/1972 | Joa | 156/62.4 |
| 3,687,749 | 8/1972 | Reinhall | 156/62.4 |
| 3,734,471 | 5/1973 | Engels | 259/6 |
| 3,752,733 | 8/1973 | Graham et al. | 161/170 |
| 3,765,971 | 10/1973 | Fleissner | 156/62.2 |
| 3,775,210 | 11/1973 | Paquette et al. | 156/181 |
| 3,791,783 | 2/1974 | Damon et al. | 425/82 |
| 3,836,412 | 9/1974 | Boustany et al. | 156/62.2 |
| 3,850,601 | 11/1974 | Stapleford et al. | 428/220 |
| 3,901,236 | 8/1975 | Assarsson et al. | 128/28 |
| 3,914,498 | 10/1975 | Videen | 428/290 |
| 3,916,825 | 11/1975 | Schnitzler et al. | 118/303 |
| 3,942,729 | 5/1976 | Fredriksson | 241/38 |
| 3,974,307 | 8/1976 | Bowen | 427/212 |
| 3,991,225 | 11/1976 | Blouin | 427/3 |
| 3,992,558 | 11/1976 | Smith-Johannsen et al. | 427/213 |
| 4,006,706 | 2/1977 | Lodige et al. | 118/303 |
| 4,006,887 | 2/1977 | Engels | 259/9 |
| 4,010,308 | 3/1977 | Wiczer | 428/391 |
| 4,015,830 | 4/1977 | Lodige et al. | 259/25 |
| 4,039,645 | 8/1977 | Coyle | 264/118 |
| 4,100,328 | 7/1978 | Gallagher | 428/407 |
| 4,111,730 | 9/1978 | Balatinecz | 156/622 |
| 4,129,132 | 12/1978 | Butterworth | 128/287 |
| 4,143,975 | 5/1979 | Lodige et al. | 366/147 |
| 4,153,488 | 5/1979 | Wiegand | 156/62.2 |
| 4,160,059 | 7/1979 | Samejima | 428/288 |
| 4,168,919 | 9/1979 | Rosen et al. | 366/173 |
| 4,181,566 | 1/1980 | Vaughn et al. | 162/164.3 |
| 4,183,997 | 1/1980 | Stofko | 428/326 |
| 4,187,342 | 2/1980 | Holst et al. | 428/283 |
| 4,188,130 | 2/1980 | Engels | 366/228 |
| 4,191,224 | 5/1980 | Bontrager et al. | 141/100 |
| 4,193,700 | 3/1980 | Wirz | 366/156 |
| 4,241,133 | 12/1980 | Lund et al. | 428/326 |
| 4,241,692 | 12/1980 | Van Hijfte et al. | 118/303 |
| 4,242,241 | 12/1980 | Rosen et al. | 260/17.2 |
| 4,243,481 | 1/1981 | Dumas | 162/158 |
| 4,252,844 | 2/1981 | Nesgood et al. | 427/213 |

(List continued on next page.)

OTHER PUBLICATIONS

German Offenlegungsschrift 1,632,450.

Article entitled "Chemically Modified Fiber as a Novel Sizing Material" by M. K. Gupta, published in Tappi, Journal of the Technical Association of Pulp and Paper Industry, vol. 63, #3.

*Primary Examiner*—Shrive Beck

*Assistant Examiner*—Benjamin L. Utech

*Attorney, Agent, or Firm*—Klarquist, Sparkman, Campbell, Leigh & Whinston

[57] ABSTRACT

Cellulose fibers are entrained in a gaseous medium and sized while entrained with a sizing material. The sizing material may comprise a nonaqueous solution of alkyl ketene dimer or other sizing material. Also, immersions of fibers in such a nonaqueous sizing solution is another approach for sizing fibers.

8 Claims, 2 Drawing Sheets

U.S. PATENT DOCUMENTS

| | | | |
|---|---|---|---|
| 4,261,943 | 4/1981 | McCorsley, III . | |
| 4,297,253 | 10/1981 | Sorbier | 260/17.3 |
| 4,302,488 | 11/1981 | Lowi, Jr. | 427/212 |
| 4,320,166 | 3/1982 | Endo et al. | 428/283 |
| 4,320,715 | 3/1982 | Maloney et al. | 118/303 |
| 4,337,722 | 7/1982 | Debayeaux et al. | 118/303 |
| 4,354,450 | 10/1982 | Nagahama et al. | 118/303 |
| 4,360,545 | 11/1982 | Maloney et al. | 427/212 |
| 4,370,945 | 2/1983 | Beckschulte et al. | 118/303 |
| 4,379,193 | 4/1983 | Hunt | 428/196 |
| 4,379,194 | 4/1983 | Clarke et al. | 428/203 |
| 4,392,908 | 7/1983 | Dehnel | 427/194 |
| 4,404,250 | 9/1983 | Clarke et al. | 428/220 |
| 4,418,676 | 4/1984 | Paquette et al. | 156/181 |
| 4,424,247 | 1/1984 | Erickson | 428/138 |
| 4,425,126 | 1/1984 | Butterworth | 604/366 |
| 4,426,417 | 1/1984 | Meitner et al. | 428/195 |
| 4,429,001 | 1/1984 | Kolpin et al. . | |
| 4,430,003 | 2/1984 | Beattie et al. | 366/173 |
| 4,435,234 | 3/1984 | Hunt | 156/62.4 |
| 4,439,489 | 3/1984 | Johnson et al. | 428/404 |
| 4,444,810 | 4/1984 | Huttlin | 427/212 |
| 4,457,978 | 7/1984 | Wawzonek | 524/14 |
| 4,468,264 | 8/1984 | Clarke et al. | 156/62.2 |
| 4,469,746 | 9/1984 | Weisman et al. | 428/289 |
| 4,478,896 | 10/1984 | Barnes et al. | 427/421 |
| 4,486,501 | 12/1984 | Holbek | 428/375 |
| 4,818,599 | 4/1989 | Marcus | 428/288 |
| 4,818,613 | 4/1989 | Ohtani et al. | 428/396 |
| 4,979,318 | 1/1989 | Brooker et al. | 428/283 |
| 4,487,365 | 12/1984 | Sperber | 239/8 |
| 4,500,384 | 2/1985 | Tomioka et al. | 156/290 |
| 4,510,184 | 4/1985 | Winkler et al. | 427/212 |
| 4,514,255 | 4/1985 | Maxwell et al. | 162/9 |
| 4,516,524 | 5/1985 | McClellan et al. | 118/683 |
| 4,547,403 | 10/1985 | Smith | 427/196 |
| 4,572,100 | 2/1986 | Schuter | 118/303 |
| 4,572,845 | 2/1986 | Christen | 427/212 |
| 4,584,357 | 4/1986 | Harding | 525/54.21 |
| 4,592,302 | 6/1986 | Motoyama et al. | 118/303 |
| 4,596,737 | 6/1986 | Werbowy et al. | 428/228 |
| 4,600,462 | 7/1986 | Watt | 156/278 |
| 4,610,678 | 9/1986 | Weisman et al. | 604/368 |
| 4,615,689 | 10/1986 | Murray et al. | 493/51 |
| 4,647,324 | 3/1987 | Mtangi et al. | 156/62.2 |
| 4,648,920 | 3/1987 | Sperber | 156/62.2 |
| 4,656,056 | 4/1987 | Leuenberger | 427/213 |
| 4,664,969 | 5/1987 | Rossi et al. | 428/284 |
| 4,673,402 | 6/1987 | Weisman et al. | 604/368 |
| 4,673,594 | 6/1987 | Smith | 427/196 |
| 4,689,249 | 8/1987 | Thygesen | 427/180 |
| 4,746,547 | 5/1988 | Brown et al. | 427/213 |
| 4,749,595 | 6/1988 | Honda et al. | 427/213 |
| 4,772,443 | 9/1988 | Thornton et al. | 264/119 |
| 4,806,598 | 2/1989 | Morman | 525/63 |
| 4,818,587 | 4/1989 | Ejima et al. | 428/198 |

METHOD OF APPLYING LIQUID SIZING OF ALKYL KETENE DIMER IN ETHANOL TO CELLULOSE FIBERS ENTRAINED IN A GAS STREAM

BACKGROUND OF THE INVENTION

The present invention relates to the application of sizing to cellulose fibers and to a sized cellulose fiber product.

Sizing of cellulose fibers is known. In one conventional approach, an aqueous emulsion of sizing is added, at the wet end of a paper making process, in dilute form to the entire pulp furnish being used to make paper. This approach results in a loss of sizing material as some of the sizing material is discarded with the "white water" resulting from this process. Also, sizing is introduced into the paper making equipment and paper making wire. As another prior art example, an article entitled *Chemically Modified Fiber as a Novel Sizing Material*, by M. K. Gupta, published in Tappi, The Journal of the Technical Association of the Pulp and Paper Industry, Volume 63, No. 3, published March, 1980, describes the sizing of cellulose fiber with Aquapel water emulsion, a sizing material from Hercules, Inc. Aquapel is a water emulsion of alkyl ketene dimer. This article mentions that only a small portion of the furnish needs to be treated with Aquapel water emulsion and also that the treated fibers may be prepared at a convenient time and simply blended into the paper furnish. As described in this article, the first step in the process of producing these sized fibers is to saturate pulp with an Aquapel water emulsion. Treatment with a 4 percent Aquapel water emulsion for a 0.2 percent retention in the final sheet is mentioned. However, drying of these treated fibers is required before they can be used to fix the sizing chemical on the paper. This approach substantially eliminates sizing from white water and from introduction into the paper making equipment because the sizing is retained on the fibers. Aquapel water emulsion can deteriorate when exposed to hot or cold climates and when exposed process conditions if simply added to the wet end of a paper making process. The process as described in thie article advantageously overcomes these problems because fiber can be sized in advance, before the shelf life of the Aquapel water emulsion is affected by environmental conditions, with the sized fiber subsequently being blended with other fiber to make paper. The use of sized fibers eliminates the need to handle and mix sizing chemicals of the wet end of a paper making process. These advantages are also present in the present invention without the disadvantage of having to dry the sized fibers prior to use under the approach of this article.

In addition, known aqueous solutions of Aquapel used in sizing fibers started with a relatively expensive raw material, namely a cationized Aquapel emulsion.

U.S. Pat. No. 3,212,961 of Weisgerber relates to the pretreatment of paper pulp with ketene dimer to improve sizability. Column one of this patent mentions that the pretreatment can be carried out in any manner which will cause the pretreating material, for example the aqueous ketene dimer emulsion, to become permanently anchored or attached to the pulp fibers. Spraying of the emulsion on the fibers is mentioned with the fibers then being dried. The Weisgerber patent does not describe how the spraying of aqueous ketene dimer emulsion is accomplished other than at column 5 where spraying of sheets with aqueous ketene dimer emulsion is mentioned. The addition of aqueous ketene dimer emulsion to an aqueous pulp suspension is also mentioned. Following pretreatment, the fibers are processed into sized paper with sizing material being added internally prior to sheet formation or externally to the sheet after it is formed. Following pretreatment, sizing agents, such as alkyl ketene dimer, are used. The sizing is described as being carried out internally by adding the sizing agent, preferably in the form of an aqueous emulsion or dispersion to the beater of a paper making system, or by surface application, as by tub-sizing, spray application or the like.

Although prior art approaches are known, a need exists for an improved method of sizing cellulose fibers and to an improved sized cellulose product.

SUMMARY OF THE INVENTION

In accordance with one aspect of the present invention, discontinuous cellulose fibers are entrained in or passed through a gaseous medium such as air. A liquid sizing material is then applied to the entrained or traveling fibers in an amount which is sufficient to produce fibers having sizing material applied and adhered to their surfaces. A substantial portion of the resulting treated fibers are unbonded. The fibers may also be combined with other nontreated fibers, such as in the furnish of a paper making process, and used to produce paper board or other products.

The liquid sizing material may, for example, comprise an aqueous alkyl ketene dimer emulsion or other suitable sizing material. However, preferably a nonaqueous solution of alkyl ketene dimer is used. For example, a relatively inexpensive and easy to store starting material, such as Aquapel 364 flakes, may be dissolved in ethanol or acetone to form the nonaqueous sizing material, rather than using a more expensive cationized Aquapel water emulsion. Other sizing materials may also be used.

In accordance with the invention, substantial amounts of sizing material may be applied to the fiber. Also, individualized sized fibers are produced which can readily be blended with other fibers, for example during a paper making process.

Although less preferred than the approach of applying sizing material to entrained fibers, it is also within the scope of the present invention to use nonaqueous solutions of sizing (such as alkyl ketene dimer) to treat cellulose fibers. For example, the fibers may simply be immersed in such a nonaqueous sizing solution, or such a nonaqueous sizing solution may otherwise be applied to the fibers.

In accordance with the present invention, substantial amounts of sizing material may be applied to the fibers. Also individualized sized fibers can be readily produced. Although variable, sizing in an amount of approximately from 1 to 20 percent and higher, and more preferably 5 to 20 percent, by dry weight of the cellulose fibers and sizing material can be obtained. In general, as the concentration of sizing increases, the treated fibers may be combined with greater quantities of untreated fibers in the finished product, while still achieving the desired sizing of the finished product. Thus, concentrations of up to 20 percent by dry weight alkyl ketene dimer, and higher, can be achieved using the preferred treatment process of the present invention.

In accordance with the invention, the sizing may be applied to the entrained fibers at one or more sizing application locations as the fibers are carried by a gaseous medium or travel through a conduit. Typically the sizing material is atomized and applied as fine droplets at each sizing applying location. In addition, turbulence is optionally imparted to the moving gaseous medium at the sizing applying location. Fibers passing through the conduit may also be heated to accelerate drying of the sizing.

The conduit may take the form of a recirculating loop through which fibers are transported a plurality of times during treatment. In accordance with the method, the fibers may be treated in continuous, batch or semi-batch processes.

The sizing material may be applied through ports in the conduit at the material applying locations. The pressure within the conduit at such material applying locations may be maintained at a lower level than the pressure externally of the conduit. As a result, fibers are maintained within the conduit rather than escaping through the ports. In addition, the sizing application means can be positioned outside of the fiber stream to thereby minimize clogging of the sizing application means by the entrained fibers.

Although not as beneficial for many applications, such as when the properties of individual fibers are desired, in addition to individual fibers, fiber bundles may also be sized in accordance with the process of the present invention. A fiber bundle is an interconnected group of two or more fibers that are not separated during processing. Fiber bundles, like individual fibers are much longer than wide. For example, when mechanically fiberized wood is produced, some individual fibers result together with fiber bundles that are not separated during the mechanical fiberization process.

It is accordingly one object of the present invention to provide a method of sizing discontinuous cellulose fibers with a sizing material.

It is another object of the present invention to provide a method of sizing such fibers which results in substantially individualized or unbonded sized fibers.

Another object of the present invention is to provide a method of applying high concentrations of sizing material to such fibers.

A further object of the present invention is to minimize the amount of sizing material required to achieve a given concentration of sizing on the treated cellulose fibers.

A still further object of one aspect of the invention is to size cellulose fibers with a relatively inexpensive alkyl ketene dimer material being used as a starting material.

Another object of one aspect of the invention is to eliminate the need for drying sized fibers prior to use.

A further object of the invention is to size cellulose fibers material without the need for pretreatment or sizing retention steps.

Still another object of the present invention is to provide a method of applying sizing materials to discontinuous cellulose fibers at a cost effective and high volume rate.

A subsidiary object of the present invention is to also size fiber bundles in the same manner as the individualized fibers are treated.

These and other objects, features and advantages of the present invention will be apparent with reference to the following detailed description and drawings.

DETAILED DESCRIPTION OF THE PREFERRED EMBODIMENTS

Figure 1:
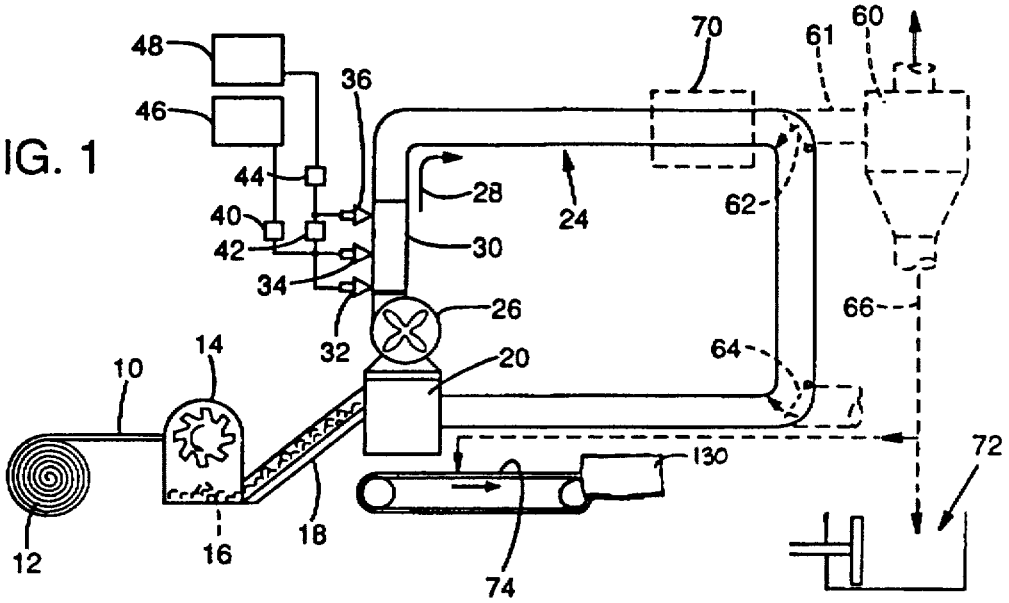
FIG. 1 is a schematic illustration of one form of apparatus in which discontinuous fibers can be treated in accordance with the method of the present invention.

The method of the present invention is applicable to sizing discontinuous cellulose fibers. The term cellulose fibers refers to fibers which are naturally occuring. The term cellulose fibers includes fibers such as wood pulp, bagasse, hemp, jute, rice, wheat, bamboo, corn, sisal, cotton, flax, kenaf, and the like and mixtures thereof. The term discontinuous fibers refers to fibers of a relatively short length in comparison to continuous fibers treated during an extrusion process used to produce such fibers. The term discontinuous fibers also includes fiber bundles. The term individual fibers refers to fibers that are comprised substantially of individual separated fibers with at most only a small amount of fiber bundles. Wood pulp fibers can be obtained from well-known chemical processes such as the kraft and sulfite processes. Suitable starting materials for these processes include hardwood and softwood species, such as alder, pine, douglas fir, spruce and hemlock. Wood pulp fibers can also be obtained from mechanical processes, such as ground wood, refiner mechanical, thermo-mechanical, chemi-mechanical, and chemi-thermomechanical pulp processes. However, to the extent such processes produce fiber bundles as opposed to individually separated fibers or individual fibers, they are less preferred. However, treating fiber bundles is within the scope of the present invention. Recycled or secondary wood pulp fibers and bleached and unbleached wood pulp fibers can also be used. Details of the production of wood pulp fibers are well-known to those skilled in the art. These fibers are commercially available from a number of companies, including Weyerhaeuser Company, the assignee of the present patent application.

For purposes of convenience, and not to be construed as a limitation, the following description proceeds with reference to the sizing of individual chemical wood pulp fibers. The treatment of individual fibers of other types and obtained by other methods, as well as the treatment of fiber bundles, can be accomplished in the same manner.

When relatively dry wood pulp fibers are being treated, that is fibers with less than about 10 to 12 percent by weight moisture content, the lumen of such fibers is substantially collapsed. As a result, when sizing materials are applied to these relatively dry wood pulp fibers, penetration of the sizing into the lumen is minimized. In comparison, relatively wet fibers tend to have open lumen through which sizing materials can flow into the fiber in the event the fiber is immersed in the sizing. Any sizing that penetrates the lumen contributes less to the desired characteristics of the treated fiber than the sizing which is present on the surface of the fiber. Therefore, when relatively dry wood pulp fibers are treated, less sizing material is required to obtain the same effect than in the case where the fibers are relatively wet and the sizing penetrates the lumen.

Sizing used to treat the fibers broadly include any sizing substances which can be applied in liquid form to entrained fibers during the treatment process. The preferred sizing material is alkyl ketene dimer available as Aquapel from Hercules, Inc. This sizing material may be applied as an aqueous emulsion. However, preferably a non-aqueous sizing material is used. For example, Aquapel in ethanol or acetone. This latter approach allows for a less expensive sizing material than catonized Aquapel emulsions because a less expensive starting material, such as Aquapel 364 flakes, may be used in producing the sizing material. That is, these flakes are simply dissolved in ethanol in the desired concentrations and then applied as explained below. Other sizing materials are of course suitable, such as alkyl succinic anhydride and Hercon. Hercon is available from Hercules, Inc. The invention is not limited to specific sizing materials.

The invention also, although less preferred, contemplates the sizing of cellulose fibers by applying non-aqueous sizing material to the fibers in any suitable manner, such as by immersion in the sizing material or spraying without an entrainment of the fibers.

When nonaqueous sizing materials are used, the fibers need not be dried to retain the sizing on the fibers. Thus, a separate drying step is not required in this case, although it is required before fibers treated with an aqueous sizing material are added to the wet end of a paper making process.

To prevent agglomeration of fibers during the treatment process when the preferred air entrainment approach is used, preferably the total liquid content of the treated fibers during treatment, including the moisture contributed by the sizing together with the moisture content of the fibers (in the case of moisture containing fibers such as wood pulp), must be no more than about 45 to 55 percent of the total weight, with a 25 to 35 percent moisture content being more typical. Assuming wood pulp is used as the fiber, the moisture contributed by the wood pulp can be higher, but is preferably less than about 10 to 12 percent and more typically about six to eight percent. The remaining moisture or liquid is typically contributed by the sizing.

With reference to FIG. 1, a sheet of chemical wood pulp 10 is unrolled from a roll 12 and delivered to a refiberizing apparatus, such as a conventional hammer mill 14. The sheet 10 is readily converted into individual fibers 16 within the hammer mill. These individual fibers are delivered, as by a conveyor 18, to a fiber loading zone 20 of a fiber treatment apparatus. In the case of a continuous process, fibers 16 are continuously delivered to the zone 20. In a batch or semi-batch process, fibers are loaded at zone 20 at intervals.

In the FIG. 1 fiber treatment apparatus, loading zone 20 forms part of a fiber treatment conduit 24. The illustrated conduit 24 comprises a recirculating loop. A blower or fan 26 in loop 24 is positioned adjacent to the fiber loading zone 20. Blower 26 is capable of moving a gaseous medium, such as air, at a velocity and volume sufficient to entrain the fibers which have been loaded into zone 20. The entrained fibers circulate in a direction indicated by arrow 28 through the loop and pass through the loading zone 20 and blower 26 each time the loop is traversed.

The velocity of air traveling in the loop is preferably set at a level where solids are uniformly dispersed and transported by the air flow. In addition, the velocity is preferably established at a level which is sufficient to avoid saltation, that is the dropping of solids or liquids from a horizontal air stream. As a specific example, when Type NB316 chemical wood pulp, available from Weyerhaeuser Company, was used as the fiber, a velocity of 5,000 feet per minute is expected to work extremely well for treatment of these fibers in accordance with the method. However, this velocity can be varied and adjusted for optimum results.

Also, the ratio of the volume of air per pound of entrained fiber is variable over relatively large ranges. One suitable example is 23.4 $ft^3$ of air per pound of fiber. As another example, 11.7 $ft^3$ of air per pound of fiber would be satisfactory.

The entrained fibers traveling in the loop pass one or more sizing material application zones, with one such zone being indicated in FIG. 1 at 30. This sizing material application zone 30 forms a part of the conduit 24. A mechanism is provided at the sizing application zone for applying a liquid sizing solution to the entrained fibers. In the FIG. 1 form of this mechanism, plural nozzles, in this case nozzles 32, 34 and 36, are used to apply the liquid sizing material. These nozzles produce an atomized spray or mist of sizing drops which impact and coat or penetrate the surface of the fibers as the fibers pass the nozzles.

In the FIG. 1 apparatus, plural valves 40, 42 and 44 may be operated to control the flow of liquid sizing material to the respective nozzles 32, 34 and 36. In the illustrated configuration, a first liquid sizing material from a tank or other source 46 is delivered to the three nozzles 32, 34 and 36 when valves 40 and 42 are open and valve 44 is closed. As the fibers recirculate through the conduit 24, and each time they pass the nozzles, an additional amount of the first liquid sizing material is applied. In this way extremely high concentrations of sizing material can be applied. Also, little sizing material is wasted as, in contrast to an approach where a solution of sizing is added to the furnish of a paper making process and sizing can be lost in white water, virtually all of the sizing material is applied to the fibers. Different surfaces of the fibers are exposed to the nozzles 32, 34 and 36 as the fibers travel through the material application zone 30. After the desired amount of the first liquid sizing material is applied, the valve 40 is closed. If desired for a particular application, a second liquid sizing or other material from a tank or other source 48 may also be applied to the fibers. With valves 42 and 44 open and valve 40 closed, this second sizing material is applied to the fibers through each of the nozzles 32, 34 and 36. In addition, the two liquid materials may be simultaneously applied, at successive locations in zone 30. For example, the valve 42 may be closed and valve 44 opened so that the first liquid sizing material is applied through nozzles 32, 34 and the second liquid sizing material is applied through nozzle 36. Also, although not required, sizing retention aids may be applied through these nozzles prior to the application of the sizing. More than two types of these materials may be applied by adding additional sources and suitable valving and nozzles.

In general, the material application zone 30 typically ranges from two to one hundred feet long, with longer application zones allowing the application of sizing over a longer period of time during passage of fibers through the material application zone. Also, longer material application zones facilitate the use of more nozzles spaced along the length of the zones.

The nozzles 32, 34 and 36 are commercially available and produce a fine mist of droplets. Typically, these nozzles provide a fan spray. Any suitable nozzles may be used, but it is desirable that the nozzles not produce a continuous stream of liquid sizing material, but instead produce droplets or a mist of such material. The nozzles are typically spaced apart from three to four feet along the length of the conduit, although they may be closer or further apart as desired.

Virtually any amount of sizing material may be applied to the entrained fibers. However, sizing in an amount of about one to twenty percent of the dry weight of the combined fibers and sizing is preferred with five to twenty percent sizing concentration being most preferred. As the sizing concentration increases, a smaller amount of the treated fiber is required to be blended with untreated fiber to produce the desired characteristics in the finished paper or other product. Sizing concentrations in excess of 50 percent, for example 90 percent or more, can be achieved utilizing the present invention. To achieve these extremely high sizing concentrations, one preferred approach is to apply a first amount of the sizing material to the entrained fibers, continue to recirculate the fibers until this first layer or application of sizing material is substantially dry, and then apply a second coating of the sizing material. Third, fourth and subsequent applications of sizing material to the entrained fibers can be made as necessary to achieve the desired level of sizing.

Following the application of the liquid sizing material to the fibers, the fibers may be retained in the loop until they have dried or be removed from the loop while they are still wet. The recirculation of the fibers may then be stopped and the fibers removed at the loading zone 20 which then functions as a fiber removal location. However, in the FIG. 1 apparatus, a cyclone separator 60 is selectively connected by a conduit section 61 and a gate valve 62 to the conduit 24. At the same time a valve 64 is opened to allow air to enter the loop 24 to compensate for air exiting through the separator 60. With the separator in the loop, the entrained treated fibers are collected in the separator and then removed from the separator at a fiber removal outlet 66. A substantial majority of the fibers processed in this manner are unbonded to one another by the sizing material. By substantial majority, it is meant that at least about 70 percent of the fibers remain unbonded. More specifically, the resulting treated fibers would be substantially unbonded, meaning that approximately 95 percent of the treated fibers would be unbonded to one another by the sizing material. Moreover, even if bonded, these fibers can be readily refiberized. However, this refiberization step and possible breakage and damage to the fibers during refiberization, is minimized when this approach is used to size the fibers.

Individualized sized fibers could be expected to be more easily dispersed or blended uniformly with other fibers, such as by air laying or blending, for subsequent use in paper making. Due to the more uniform distribution of sized fibers, the resulting paper product is expected to exhibit more uniform water repellency.

An optional means for heating the sizing coated fibers may be included in conduit 24. For example heated air may be blended with the air flowing through the conduit. Similarly, a heater 70 may be included in conduit 24 for heating the fibers. This added heat accelerates the drying of the liquid sizing.

The fibers are preferably not heated prior to the application of the sizing material. Heating the fibers would result in elevated temperatures at the sizing application zone 30 These elevated temperatures can cause some of the sizing to at least partially dry before reaching surfaces of fibers passing through the sizing application zone 30. The solidified sizing either does not adhere, or only adheres weakly to the fibers. In addition, droplets of sizing which impinge heated fibers tend to dry in globules on the fibers, rather than spread across the surface of the fibers to provide more uniformly sized fibers.

The dried fibers from outlet 66 of the cyclone separator 60 may be deposited in a conventional baling apparatus 72. When compressed, these fibers remain unbonded by the sizing material and therefore can be readily separated into individualized fibers for subsequent use.

Also, treated fibers which have only been partially dried, and thus which are still somewhat wet with the sizing material, may be deposited from outlet 66 loosely onto a conveyor 74 or in a loose uncompressed pile at a collecting zone (not shown). These fibers can then be allowed to dry. Alternatively, the treated fibers may be carried by the conveyor 74 through a heater (not shown), operable like heater 70, to accelerate the drying of the fibers. The resulting product again contains a major portion of unbonded fibers. However, the wetter the fibers and more dense the resulting web when deposited on belt 74, or in a pile, the more sizing-to-sizing bonds that occur. Thus, in many cases it is preferable to at least partially dry the fibers within the conduit 24 prior to removing the fibers therefrom. However, the fiber may be air laid either dry or wet, that is with no more than about a 55 percent total moisture content in the fibers and sizing thereon, directly into a web or delivered, with or without other untreated fibers to a paper making or other processing apparatus 130.

The FIG. 1 apparatus may be operated in a batch mode in which fibers are introduced, fully treated and removed. Alternatively, a semi-batch approach may be used in which fibers are added and some, but not all, of the fibers removed from the loop. Also, the FIG. 1 apparatus may be operated in a continuous mode in which fibers are introduced at zone 20 and removed by the cyclone separator 60 with or without recirculating through the loop. The gate valves 62, 64 may be opened to a desired extent to control the amount of fiber that is removed. This quantity of removed fiber is preferably equal to the amount of untreated fiber that is introduced into the loop. In this nonrecirculating case, the zone 30 is typically expanded.

Figure 2:
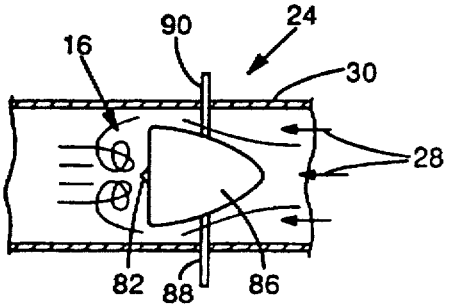
FIG. 2 is a side elevational section view of one form of sizing application mechanism which can be used to apply liquid sizing material to discontinuous fibers in accordance with the method of the present invention.
Figure 3:
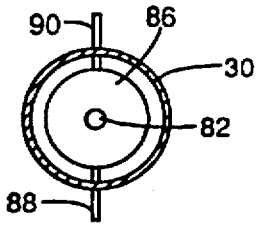
FIG. 3 is a front elevational section view of the sizing application mechanism of FIG. 2.

With reference to FIGS. 2 and 3, another mechanism for applying sizing material to the fibers is illustrated. Rather than using external spray nozzles such as 32, 34 and 36, plural nozzles (i.e., one being shown as 82 in FIGS. 2 and 3) are included in the conduit at the sizing material applying zone 30. The nozzle 82 applies a fine spray of liquid sizing material onto the fibers 16 as they move past the nozzle. The FIGS. 2 and 3 sizing applying mechanism includes a means for imparting turbulence to the air as it passes the nozzles. As a result, the fibers 16 tend to tumble in front of the nozzles and expose different surfaces to the applied sizing material. The illustrated turbulence imparting mechanism comprises a blunted conical air deflection baffle 86 supported within the conduit 24 by rods, with two such rods 88 and 90 being shown. Rod 90 may be hollow to provide a pathway through which sizing material is delivered to the nozzle 82. Of course, other turbulence imparting mechanisms may also be used.

Figure 4:
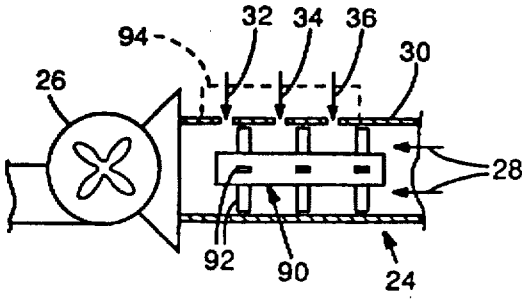
FIG. 4 is a schematic illustration of another form of sizing application mechanism which can be used for practicing the method of the present invention.

In FIG. 4, a rotary mixer 90 with plural mixing paddles, some being indicated at 92, is disposed within the conduit 24 at the sizing material applying zone 30. This mixer is rotated by a motor (not shown) to impart turbulence to fibers as they pass the mixer paddles. The nozzles 32, 34 and 36 are disposed externally of the conduit 24 for directing the sizing material through ports or openings to the fibers passing the mixer. These nozzles may be enclosed in a shroud or cover as shown by dashed lines 94 in this figure. However, in the FIG. 4 approach, blower 26 has been shifted to a location downstream from the material applying zone 30. Consequently, the material applying zone is at a relatively low pressure with a slight vacuum being present in the material applying zone relative to the pressure outside the conduit at this zone. Consequently, fibers passing the nozzles 32, 34 and 36 tend to be drawn into the conduit rather than escaping through the sizing applying ports. As a result, the nozzles can be positioned outside of the conduit where they are not subject to being clogged by the passing fibers.

Figure 5:
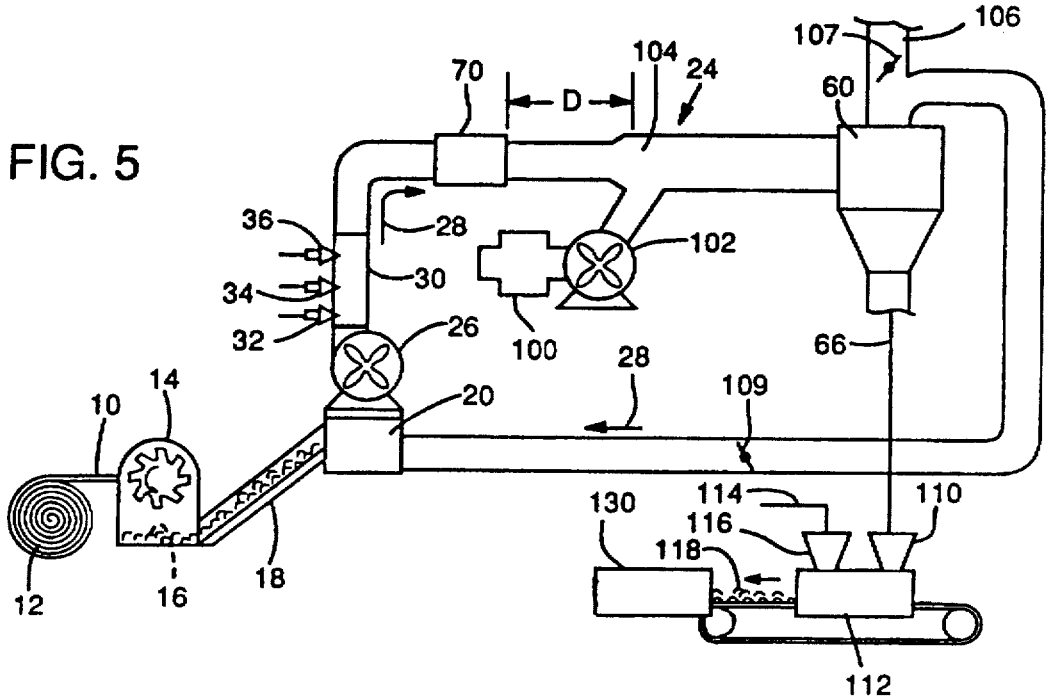
FIG. 5 is a schematic illustration of an apparatus used in performing an alternative form of the method of the present invention.

Referring to FIG. 5, an apparatus is shown for practicing an alternative method of the present invention. In FIG. 5, for purposes of convenience, elements in common with those of FIG. 1 have been given like numbers and will not be discussed in detail.

In general, the FIG. 5 form of the apparatus allows the continuous processing of fibers with the fibers passing only once through the sizing material application zone 30. However, the zone 30 is typically of an extended length with more nozzles (i.e. six to twelve or more) than shown in FIG. 5. The fibers may pass through a heater or oven 70, or heated air may be blended with the air stream which entrains the fibers, for drying purposes and then may travel through a distance D at the elevated temperatures created by this heat. As a typical example, D may be 150 feet with the time required to travel the distance D enabling the sizing on the entrained fibers to become substantially dry. Optionally, cooling air from a refrigeration unit 100 or ambient air from the environment may be delivered by a blower 102 to the conduit 24 at a location 104 in the conduit. This cooling air lowers the temperature of the dried and treated fibers. The cooling air may be dehumidified prior to introduction to conduit 24 to minimize any condensation that may otherwise occur in the conduit. Cyclone separator 60 may be provided with a bleed line 106 for venting the air during separation. Although less preferred, this air may be recirculated back to the fiber loading zone 20. Flow control gate valves 107, 109 may be included in the system to balance the air flow through the various conduits of the illustrated system.

The treated fibers from outlet 66 of the separator 60 may be fed to a hopper 110 of a conventional fiber blending unit 112. Other fibers, such as wood pulp fibers or synthetic fibers are fed, in a desired proportion for the resulting product, by way of a conduit 114 to another hopper 116 and then to the blending unit 112. The fibers from outlet 66 can also be used without blending them with other fibers. The blended treated and untreated fibers 118 are shown being deposited on a conveyor and being carried to a paper making apparatus or other processing equipment 130. The treated fibers may also be delivered directly to the furnish as a paper making apparatus. The resulting material can be used in a conventional manner to manufacture a wide variety of products, such as paper board as one example.

Figure 6:
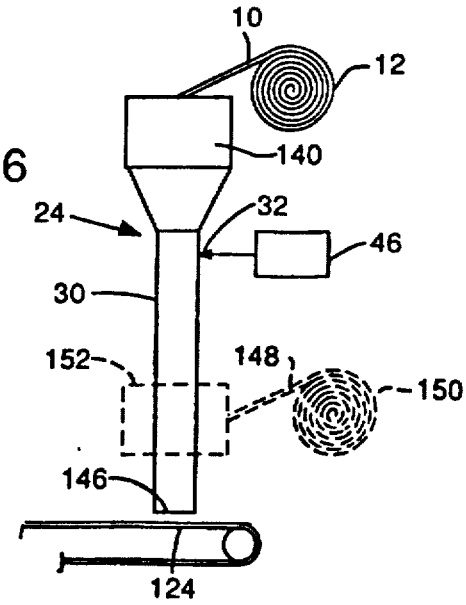
FIG. 6 is a schematic illustration of an apparatus for performing still another embodiment of the method of the present invention.

In the FIG. 6 form of apparatus used to practice the method of the present invention, the fibers to be treated may be delivered in loose form or in the form of a sheet 10 from roll 12 to a first hammer mill or refiberizing device 140. The resulting fibers travel through air or another gaseous medium in conduit 24 and through a sizing applying zone 30. If the fibers are not conveyed horizontally but merely pass downwardly in the conduit, the air velocity need not be as high. In this sense the fibers are not air entrained, but merely travel through the conduit. At zone 30, a first sizing material 46 is applied to the fibers by way of nozzle 32. Again, this is a schematic representation of the apparatus, as plural nozzles are preferably employed. Thus, the sizing material applying zone is substantially elongated over that which is shown. The treated fibers may be air laid or otherwise deposited, wet or dry, directly on a face sheet (not shown), directly on a conveyor 124, or be delivered directly to the furnish of a paper making apparatus. Typically a vacuum (not shown) is used to draw the fibers against the screen so that the fibers are not simply falling under the influence of gravity.

A web of untreated fibers 148 from a roll 150 is optionally delivered to another hammer mill 152 for fiberization and blending with the treated fibers prior to depositing the blend on the conveyor 124. The deposited fibers may then be processed, such as previously described, for use in manufacturing a variety of products.

The following examples will serve to more specifically illustrate the method of the present invention, although it is to be understood that the invention is not limited to these examples.

EXAMPLE 1

A bleached Kraft Southern Pine cellulose fiber pulp sheet (NB-316 from Weyerhaeuser Company) was fiberized in a hammer mill. Fiberized fluff was then entrained. Alkyl ketene dimer, namely, Aquapel 364 flakes dissolved in ethanol, was then sprayed onto the air entrained fibers. Fibers having 10 percent, 5 percent and 2 percent sizing have been produced with the percentage being the percentage of sizing of the total dry weight of the sizing and fiber combined.

These 2, 5 and 10 percent sized fibers were then respectively blended with sufficient untreated fibers and used to produce paper sheets with a 0.2 percent Aquapel sizing level in the final sheet. All of these sheets exhibited excellent sizing that is greater than 300 seconds when tested using the conventional Hercules Inks Test.

Also, in a pilot run of a paper making machine, printing paper at 74 g/m$^2$ and milk carton top ply paper at 160–170 g/m$^2$ was produced. When a nonaqueous sizing material was used these papers exhibited substantially equivalent sizing with and without a retention agent. In this specific case, Kymene was used as a retention agent and Aquapel 364 flakes dissolved in ethanol was used as the sizing material.

In comparison, when an Aquapel water emulsion is used as a sizing, substantially equivalent results were only obtained when a retention agent is used.

Aquapel dissolved in acetone is another example of a nonaqueous sizing material which can be used. The treated fiber can then be recirculated prior to separation in a cyclone. The still somewhat wet coated fiber can then also be deposited in a loose pile and air dried at room temperature for 24 hours. Even though wood fibers are of irregular cross-section and thus more difficult to coat than surfaces with a regular cross section or smooth surface, the resultant fibers had a uniform treatment of sizing material. Also, approximately 95 percent of the fibers were unbonded to one another by the sizing material. The dried fiber can then easily be air laid into a web or delivered to paper making or other processing equipment. In a recirculating system, to achieve higher percentages of the sizing concentration, the fibers can be were recirculated in the loop during liquid sizing application for a longer time. Substantially unbonded individualized fibers sized with the sizing material can be produced in accordance with the method of the present invention.

EXAMPLE 2

This example is similar to example 1, with the exception that an aqueous alkye ketene dimer emulsion, such as described in the article entitled "Chemically Modified Fiber as a Novel Sizing Material" can be used. The results are expected to be the same as set forth in the article.

EXAMPLE 3

The fibers may also be immersed in a nonaqueous liquid sizing material for treatment. However, agglomeration of the fibers is expected to result.

EXAMPLE 4

This example demonstrates the applicability of the process to sizing cellulose fibers and fiber bundle material. Specifically, 1111 grams of a mechanically fiberized wood (10 percent moisture) can be placed in a recirculating conduit 24 with an in-line blower. The blower can be turned on to entrain the wood fibers. Aquapel dissolved in ethanol (i.e. 5 percent Aquapel 364 flakes) can be sprayed onto the fiber through a port in the conduit. After addition of the sizing material, the treated fibers can be shunted out of the loop 24, collected in a cyclone 60 and spread on a bench to air dry. Individual sized fibers and individual sized fiber bundles would result without significant fiber to fiber, fiber to fiber bundle, or fiber bundle to fiber bundle agglomeration.

Having illustrated and described the principles of our invention with reference to several preferred embodiments and examples, it should be apparent to those of ordinary skill in the art that such embodiments of our invention may be modified in detail without departing from such principles. We claim as our invention all such modifications as come within the true spirit and scope of the following claims.

We claim:

1. A method of sizing cellulose fibers comprising:
   entraining cellulose fibers in a gaseous medium with the gaseous medium transporting the fibers through a conduit in a fiber gas stream and at a velocity which is sufficient to avoid saltation of the fibers within the conduit; and
   applying a liquid sizing comprising alkyl ketene dimer in ethanol to the entrained cellulose fibers in the fiber gas stream.

2. A method according to claim 1 including the step of drying the fibers.

3. A method according to claim 1 in which the conduit is in the form of a loop and the fibers are recirculated through the loop a plurality of times for repeated application of the liquid sizing.

4. A method of sizing cellulose fibers comprising:
   entraining cellulose fibers in a gaseous medium; and
   applying a nonaqueous solution of alkyl ketene dimer in ethanol to the entrained cellulose fibers.

5. A method according to claim 4 in which the applying step comprises the step of coating the cellulose fibers with approximately one to twenty percent by dry weight alkyl ketene dimer.

6. A method according to claim 5 in which the applying step comprises the step of coating the cellulose fibers with approximately twenty percent by dry weight alkyl ketene dimer.

7. A method of sizing cellulose fibers comprising:
   entraining cellulose fibers in a gaseous medium; and
   applying a nonaqueous liquid sizing material comprising alkyl ketene dimer in ethanol to the entrained cellulose fibers.

8. A method of sizing cellulose fibers comprising the step of applying a solution of alkyl ketene dimer in ethanol to the cellulose fibers.

* * * * *

UNITED STATES PATENT AND TRADEMARK OFFICE

CERTIFICATE OF CORRECTION

PATENT NO. : 5,071,675
DATED : December 10, 1991
INVENTOR(S) : Maharaj K, Gupta; Amar N. Neogi, and Richard H. Young It is certified that error appears in the above-indentified patent and that said Letters Patent is hereby corrected as shown below:

On the title page: Item [56]Reference Cited:

4,572,100, "Schuter" should be --Schluter --.

Signed and Sealed this

Fourteenth Day of March, 1995

*Attest:*

Bruce Lehman

BRUCE LEHMAN

*Attesting Officer*

*Commissioner of Patents and Trademarks*